US006116177A

United States Patent [19]

Conant

[11] Patent Number: 6,116,177

[45] Date of Patent: Sep. 12, 2000

[54] MAST WITH TOP BOOM

[76] Inventor: Carson V. Conant, 1930 W. Ridgewood, Glenview, Ill. 60025

[21] Appl. No.: 09/085,912

[22] Filed: May 28, 1998

[51] Int. Cl.[7] ..... B63B 15/00; B63B 9/04

[52] U.S. Cl. ..... 114/91; 114/97; 114/102.16

[58] Field of Search ..... 114/90, 91, 39.32, 114/39.29, 102.1, 102.16, 102.17, 102.18, 102.19, 102.2, 102.21, 102.29, 97, 98

[56] References Cited

U.S. PATENT DOCUMENTS

| | | | |
|---|---|---|---|
| 2,364,578 | 12/1944 | Wilkie . | |
| 2,944,505 | 7/1960 | Berge | 114/102.19 |
| 3,195,494 | 7/1965 | Robin | 114/39.32 |
| 3,827,386 | 8/1974 | Faden . | |
| 4,044,702 | 8/1977 | Jamieson . | |
| 4,230,060 | 10/1980 | McCoy . | |
| 4,273,060 | 6/1981 | Pavincic . | |
| 4,369,726 | 1/1983 | Mader . | |
| 4,665,854 | 5/1987 | Meyer . | |
| 4,690,088 | 9/1987 | Perini . | |
| 4,886,008 | 12/1989 | Puckett . | |
| 4,940,008 | 7/1990 | Hoyt . | |
| 4,972,789 | 11/1990 | Greppi . | |
| 5,083,520 | 1/1992 | Bonnet . | |
| 5,392,726 | 2/1995 | Benze . | |
| 5,423,274 | 6/1995 | Benze . | |

FOREIGN PATENT DOCUMENTS

| | | | |
|---|---|---|---|
| 274232 | 7/1988 | European Pat. Off. | 114/91 |
| 8600661 | 10/1987 | Netherlands | 114/91 |

*Primary Examiner*—Sherman Basinger
*Attorney, Agent, or Firm*—Richard P. Gilly

[57] ABSTRACT

An improved mast assembly for use on a sailing vessel having both an upper boom and a lower boom that allows a user to control the upper section of the sail independently or in conjunction with the lower section of the sail. The mast of the assembly is positioned away from the sail thereby utilizing a wire leading edge resulting in decreased wind turbulence, increased efficiency of the sail and greater sailing control over the rig and the entire vessel.

40 Claims, 13 Drawing Sheets

FIG. 2C
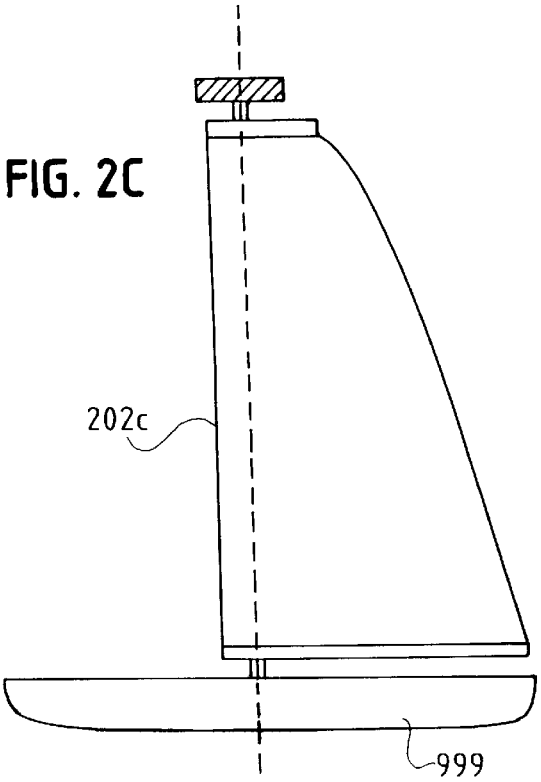
FIG. 2D
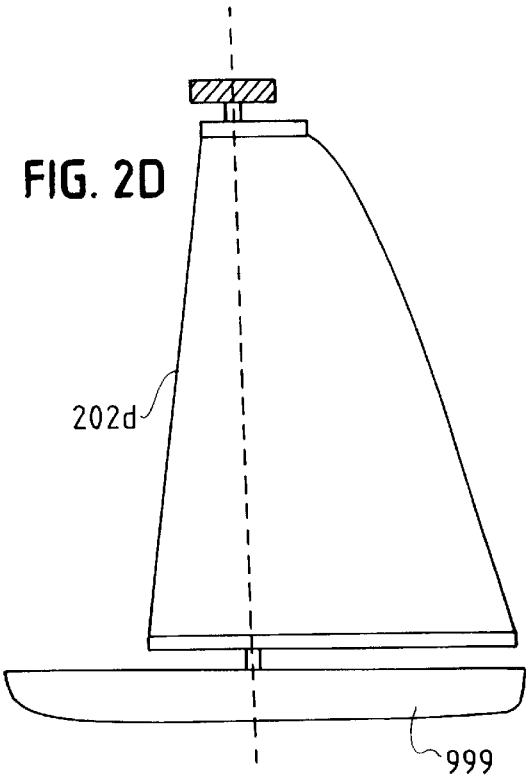
FIG. 2E
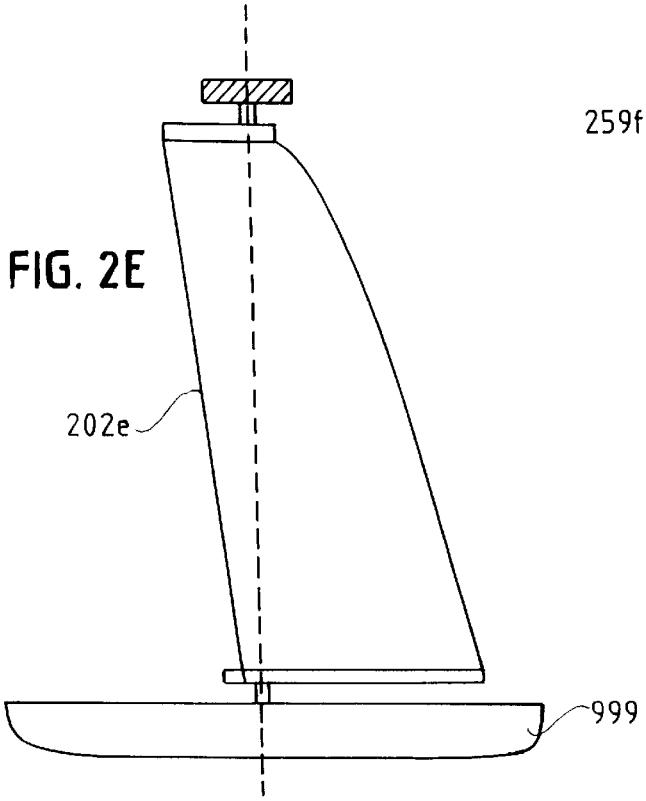
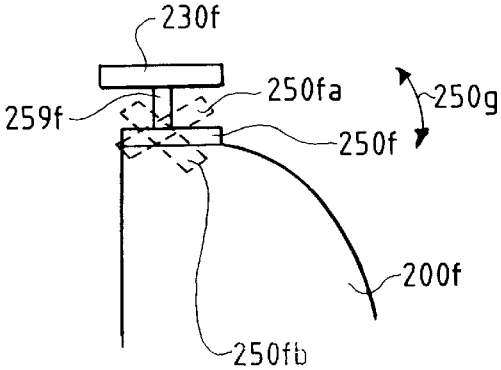
FIG. 2F

MAST WITH TOP BOOM

BACKGROUND OF THE INVENTION

1. Field of the Invention

This invention relates to mast assemblies in general, and more particularly, to a non-traditional or unconventional mast assembly where an additional boom member is provided along the upper edge of the sail to increase the sail surface area, reduce sail top deflection and allow for independent control of the sail base and top.

2. Preliminary Discussion

Mankind has for centuries had a devotion to the art of sailing. Since the dawn of recorded history, humans have been utilizing the power of the wind to propel water borne and even ocean-going vessels. The first boats were configured with pocket-like sails which caught the wind flowing from behind the boat and propelled the boat in the general direction of the wind. One of the primary focuses of modern nautical engineering has been toward sail designs that allow the boat to travel closer to the wind, i.e. with a lesser angle between the boat and wind directions. Most modern boats can sail within 35° of the wind direction under average conditions. However, since the days of Julius Caesar, it is estimated this figure has only dropped by 15° from a minimum angle of 50° to the wind. The reason is that as the angle to the wind decreases, the turbulence generated by a conventional vertical mast increases and the sail stalls, or in aerodynamic terms does not produce "lift." Nevertheless, the race to design a boat capable of sailing farther into the wind still continues. One of the principal reasons sailing is pleasant is that "you can sail your trusty boat in any direction, regardless of where the ornery wind happens to be blowing."

A second drawback to the conventional vertical mast is the lack of control of the sail top. A "boom," positioned at the lower end of the sail, or along the sail base, controls the general angle of attack of the sail by regulating the position of the sail base. However, without a top boom or similar positioning device of some sort, the sail top deflects independently of the bottom boom. Such deflection is a function of the sail material, wind speed and wind direction. Consequently, the sail does not maintain the most efficient or desirable angle of attack along its length. A so-called Marconi or triangular sail alleviates this problem to a considerable extent by simply omitting sail material or essentially half the sail with tension on the sail so the outer edge is stretched and stiffened. Gaff rigged sails have been frequently used both on so-called fore and aft rigs and also, of course, on so-called square sail rigs. Gaff rigs are difficult to control, however, particularly in so-called fore and aft rigs and the use of the gaff-type rig has declined in favor of the Marconi rigs. The gaff rig, in any event, was designed primarily to prevent the sail from losing its shape and support a large sail on a short mast, not to control the top angle of attack of the sail to the wind.

A conventional sail, which is really just a thin flexible member, translates the fluid motion of the wind into propulsive power by capturing the wind in the "pocket" of the sail such that the sail forms a foil-like shape similar to that of an airplane wing. This wing shape is such that the difference in curvature creates a pressure difference across the wing or sail, thereby generating "lift" and "drag" forces on the sail. These sail forces result in a net force on the boat transferred through the mast. The component of the net boat force in the direction of travel is the "propulsive" force and the complimentary force, perpendicular to the direction of travel, is the heeling force. If the propulsive force exceeds the net drag forces on the boat, forward motion is achieved.

A conventional vertical mast-sail system has one serious flaw. Because the surface of the mast facing the wind is hundreds of times larger than the thickness of the sail, the air leaving the mast's trailing edge is turbulent, thereby creating a large turbulent wind "shadow" along the sail's leading edge. Since the largest "lift" force occurs at the sail's leading edge, the turbulent wind shadow caused by the mast destroys much of the sail's "lift" or drive potential transverse to the direction of the wind. To correct for this inefficient leading edge, boat manufacturers reduce the main sail area and overcompensate with a large front sail, or "jib." The jib has a so-called "wire" leading edge that is approximately 20 times thicker than the thickness of the main sail compared to the mast which may be in approximate terms hundreds of times thicker. As a result, the wire produces a smaller, negligible turbulent wind shadow, thereby utilizing the full leading edge lift or drive force.

However, there are problems associated with using a large jib and a small main sail. Because the jib produces the majority of the propulsive force, a net force moment results about the center of the boat and the captain must compensate with the rudder in order to maintain a straight course. The result is increased drag from the rudder or rudders. However, as inefficient as this method is, it surpasses the traditional large main sail configuration and has been adopted by most nautical engineers in high performance boats.

Even with the advent of the powerboat, the constant research and improvements in sailing design have not ceased, with the major areas of focus being on sailing speed and sailing direction, each a function of "lift" or drive generated by the sail and sail efficiency respectively. There is always a need, therefore, to improve upon existing designs in an effort to create a faster, more efficient sail assembly.

The present inventor has met the challenge and designed a novel mast/boom assembly that overcomes or nearly eliminates the inefficiencies of the prior sail constructions. The assembly of the present invention departs from the conventional vertical mast system with a non-traditional mast assembly that essentially eliminates the turbulent wind shadow created by such vertical mast, as previously discussed, and replaces the conventional vertical mast with a "wire leading edge," i.e. an unimpeded edge along the leading edge of the sail. The entire sail is thereby allowed to enjoy an uninterrupted windstream which increases the efficiency and aerodynamic properties of the sail as a whole. In one embodiment, the mast of the present invention is in the shape of an "A"-frame with the sail appropriately supported between the "legs" of the "A" such that the sail's leading edge is unobstructed.

The present inventor has also devised an additional boom assembly that, among other things, increases the sail surface area through a modification of the sail shape. A separate "top" boom situated along the upper edge of the sail flattens the upper section of the sail and transforms it from a pointed configuration. Unlike the sail base that is fixed along its length, the sail top is usually fixed at only one point. Consequently, the sail top pressure difference with a pointed configuration does not generate lift, but rather, causes deflection of the sail trailing edge. This deflection tends to disturb the sail aerodynamics by disturbing or reducing the pressure differences about the sail, with a consequential net pressure difference and, therefore, a reduction in net "lift." The "top" boom of the invention effectively overcomes the deflection by creating a second sail edge that is fixed, similar to the base of the sail that is fixed along its length by the traditional or lower boom. Means are provided to attach the top boom to the mast assembly of the present invention in a controllable fashion, and further means are provided to control the movement of the top boom both independently and in conjunction with the lower boom.

The combination of the non-traditional mast assembly and "top boom" results in a superior sailing structure or configuration that overcomes the inefficiencies and deficiencies of the prior art. Coupled with the increased efficiency attributed to a wire leading edge, the "A"-frame embodiment with top boom configuration promises to be an improvement over all existing sail configurations in the area of lift generation. The ability to sail closer to the wind and generate greater lift or drive could prove to be the most significant advance since the advent of the winged keel.

3. Description of Related Art

The prior art evidences a continuing evolution in sail and mast design. The prior art does not, however, contemplate a mast assembly comprising the elements of the present invention. Some of the prior art references of note are as follows.

U.S. Pat. No. 2,364,578 issued to L. A. Wilkie on Dec. 5, 1944, entitled "Sailboat," discloses a wishbone-type double mast with an upper boom and without a lower, conventional boom. The upper boom of the Wilkie reference does not function in a manner similar to the present inventor's "top boom" since it does not support the tip of the sail. The Wilkie upper boom increases the wind-exposed surface area through a different wind exposure pattern across the face of sail. The deficiencies of the unsupported tip remain, however.

U.S. Pat. No. 3,827,386 issued to C. Faden on Aug. 6, 1974, entitled "Means for Lowering the Mast on Sailboats," discloses a slidable, collapsible mast. The sail assembly remains more or less conventional.

U.S. Pat. No. 4,044,702 issued to R. S. Jamieson on Aug. 30, 1977, entitled "High Efficiency Aerodynamic Sail System for Boats, and Method for Sailing," discloses a non-conventional tripod mast structure with a mast and swivel fitting for pivotal support of the sail head. Rotational support of the sail is accomplished without the use of a top boom or gaff or the like. The Jamieson sail does not operate on a wire leading edge like the assembly of the present invention.

U.S. Pat. No. 4,273,060 issued to I. Pavincic on Jun. 16, 1981, entitled "Sailing Vessel," discloses a non-traditional sailing system based on an omnidirectional hull arrangement. There is no mention of a collapsible mast or top boom assembly, but a double mast is shown.

U.S. Pat. No. 4,690,088 issued to F. Perini on Sep. 1, 1987, entitled "Sail Rigging with Fairing," discloses a small upper boom or peak situated near the mast head. Such peak function is well known in the prior art, and is not similar to that of the novel "top" boom of the present invention.

U.S. Pat. No. 4,886,008 issued to L. J. Puckett on Dec. 12, 1989, entitled "Frame Spar for Soft Airfoils," discloses a couple of different embodiments of an A-frame mast assembly. There is, however, no disclosure of a "top" boom assembly.

U.S. Pat. No. 4,940,008 issued to J. G. Hoyt on Jul. 10, 1990, entitled "Foldable Mast Assembly," discloses a foldable mast with a conventional mast leading edge. There is no mention of a "top" boom assembly.

U.S. Pat. No. 5,083,520 issued to C. Bonnet on Jan. 28, 1992, entitled "Mast, in Particular for Sailing Boat," discloses a vertical rockable plate located at the coupling of two masts at the mast heads designed to reduce the transference of any load, torque or twist to the mastheads from the rigging. Bonnet's plate is designed to alleviate rigging stresses upon the mast components.

U.S. Pat. No. 5,392,726 issued to T. A. Benze on Feb. 28, 1995, entitled "Sailboat" discloses a centrally swivelled lower or main boom within a dual mast assembly and Benze's continuation-in-part U.S. Pat. No. 5,423,274 issued on Jun. 13, 1995, discloses a swivel plate at the upper end of a similar dual stationary mast assembly. A rotatable sail boom capable of a 360° rotation (two 180° fore and aft rotations) allows the sail to accommodate changing wind patterns without requiring movement of the primary boom and mast assembly.

The prior art fails to disclose a non-traditional mast assembly with an upper and lower boom and an expanded sail area having a "wire" leading edge as opposed to a conventional, vertical mast leading edge. Furthermore, the prior art fails to disclose a mast/sail assembly with the ability to control the upper edge of the sail either independently or in conjunction with the lower edge of the sail. The "top boom" of the present invention operates within the framework of the present inventor's non-traditional mast to create an improved, highly efficient and proficient mast/sail structure with superior aerodynamic and control properties.

OBJECTS OF THE INVENTION

It is an object of the present invention, therefore, to provide a mast assembly having improved lift generation and enhanced control capabilities.

It is a further object of the present invention to provide a mast assembly with a sail structure having a wire leading edge resulting in reduced wind shadow turbulence and improved efficiency as compared with conventional vertical mast constructions.

It is a still further object of the present invention to provide a mast assembly with a sail that is unobstructed by a conventional vertical mast.

It is a still further object of the present invention to provide a mast assembly having a sail with a definable upper edge and increased surface area resulting in an overall improvement in aerodynamic capabilities.

It is a still further object of the present invention to provide a mast assembly having an "A" frame construction with the sail positioned and rotatable within the confines of the mast structure.

It is a still further object of the present invention to provide a mast assembly having an additional top boom attached to the upper edge of the sail that is rotatable within the mast assembly.

It is a still further object of the present invention to provide a mast assembly having an additional top boom attached to the upper edge of the sail that is controllably rotatable within the mast assembly such that the top of the sail may be rotated or positioned independently and/or in conjunction with the bottom of the sail.

It is a still further object of the present invention to provide a mast assembly that is capable of collapsing onto the deck of the sailboat.

Still other objects and advantages of the invention will become clear upon review of the following detailed description in conjunction with the appended drawings.

SUMMARY OF THE INVENTION

The assembly of the present invention comprises a non-traditional mast, preferably in the shape of an "A" frame, although other geometrically shaped frames may be used such as a square frame and the like, a conventional lower or main boom that retains the lower section of the sailboat sail and an upper or top boom suspended from the upper section of the mast that retains the upper section of the sailboat sail. The upper boom is flat or maintained essentially horizontal so it casts no wind shadow on the sail in the same manner that the lower boom essentially casts no shadow. Each boom allows a sailor to control each respective area of the sail independently or in conjunction with each other.

Conventional mast assemblies usually only have a single boom along the lower edge of the sail, with control of the upper section of the sail being relatively non-existent except by whatever tension can be maintained along the sail. It is generally known that the sail top deflects almost independently of the bottom boom, with this deflection being a function of the sail material, wind speed and wind direction. Conventional mast assemblies also experience considerable turbulence along the leading edge of the sail because the mast forms the backbone of the sail and is, therefore, very close to the sail.

To correct for the sail top deflection, the present invention employs a horizontal member or boom at the top of the sail similar to the boom located at the base of the sail. This top boom prevents deflection by allowing the operator to control the sail top independently or in conjunction with the sail bottom. The conventional bottom boom, used by all major boat manufacturers, controls the Angle of Attack (AOA) of the sail base. A top boom would allow independent control of the sail top by the same means, thereby maintaining the same angle of attack along the sail top and base. Control of the sail top would be advantageous in high wind situations where the force on the sail perpendicular to the boat axis can cause the boat to tip or "heel." If this "heeling force" becomes too great, the boat can capsize. Boaters usually compensate for the heeling force on a long term basis by reducing the exposed sail area in a difficult and time-consuming process known as "reefing," and on a short term or emergency basis by letting out the boom to spill wind from the sail or by bringing the head or bow of the boat more into or against the wind. In the apparatus of the present invention, however, the need for reefing will be diminished by increasing the top boom AOA while maintaining the bottom AOA at the angle of maximum lift, resulting in some of the air being "spilled" off the top of the sail and not only the bottom boom but also the top boom can be selectively released to "spill" wind from the sail.

The non-traditional mast assembly of the present invention, preferably in the form of an "A"-frame, has the additional advantage of sail shape diversity because the shape is not limited to a vertical leading edge by a traditional mast. An "A"-frame mast, for example, employs a wire leading edge rather than a conventional mast, where support of the sail is derived from two masts located on either side of the boat with a common point above the boat center. A wire leading edge reduces the amount of wind turbulence experienced at such leading edge thereby resulting in more efficient "lift" or drive force, similar to that of the conventional jib.

BRIEF DESCRIPTION OF THE DRAWINGS

FIGS. 2C through 2F are side views of the mast assembly of the present invention showing alternate sail leading edge angle positions and FIG. 2F is a diagrammatic side view that illustrates the pivotability of the upper and lower booms of the present invention.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
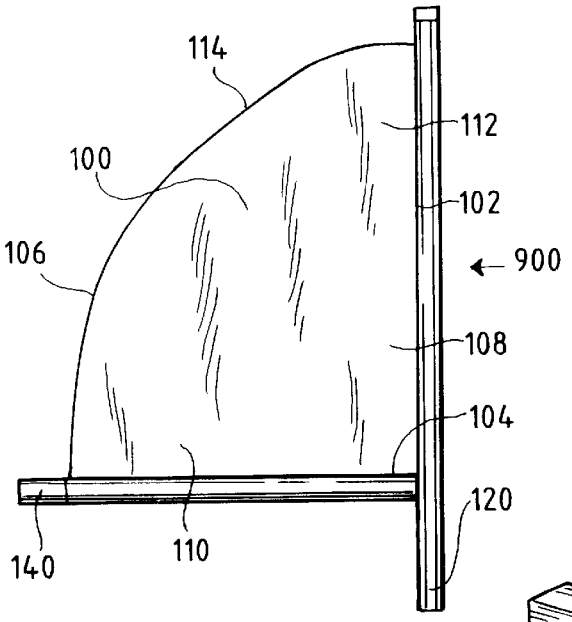
FIG. 1 PRIOR ART
FIG. 1 is a side view of a simplified, traditional mast assembly.

FIG. 1 is a side view of a simplified, traditional mast assembly, having a sail 100 attached to a mast 120 along its leading edge 102 and a boom 140 along its base or lower edge 104. Attachment of the sail 100 to the mast 120 and boom 140 can be accomplished in a variety of ways, depending on the age and/or sophistication of the equipment. As wind 900 impacts against the mast 120, a turbulent wind shadow is created along the sail's leading edge 102 and the luff region 108 of the sail 100 due to the enlarged circumference of the mast 110. It is therefore important, with conventional mast assemblies, that the sail 100 be attached as closely and as cleanly as possible to the mast 120 so that the turbulent wind conditions along the leading edge 102 and luff region 108 of the sail 100 have the least impact on the foil shape of the sail 100 when the sail is filled with wind 900. The boom 140 enables a sailor to control the direction of the lower region 110 of the sail 100 to alter or vary the sail shape in response to changing wind conditions. The boom 140 traditionally does not also allow the sailor to closely control the upper region 112 of the sail 100, and especially not the upper edge 114 or top of the sail 100. The boom 140 is therefore said to control the general "angle of attack" of the sail by regulating the position of the sail base 110. However, lacking this element of control the sail top 112, and more particularly the upper edge 114, deflects more or less independently of the boom 140. Some control can be obtained by keeping the sail tensioned by downward tension upon the boom 140, but this is very difficult to achieve while still allowing freedom of the boom to compensate for variations in the wind. The deflection of the outer sail edge, the degree of which deflection is largely a function of the sail material, wind speed, wind direction and the like plus the tension in the sail material along such edge, results in a non-uniform sail shape along the entire leech edge 106 resulting in an inefficient or undesirable angle of attack of the sail with respect to the wind. The improved mast assembly of the present invention provides very reduced turbulence at the leading edge 102 of the sail 100 and a greater degree of sail control at the upper section 112 or along the upper edge 114 of the sail 100 by reconfiguring and repositioning the mast 120 away from the leading edge 102 of the sail 100 and by providing a second more or less horizontal boom member (shown in subsequent figures) along the upper edge 114 of the sail 100 to allow a sailor to control the rotation of the upper region 112 similar to that experienced or possible with the lower region 110 via the manipulation of the lower boom 140.

Figure 2:
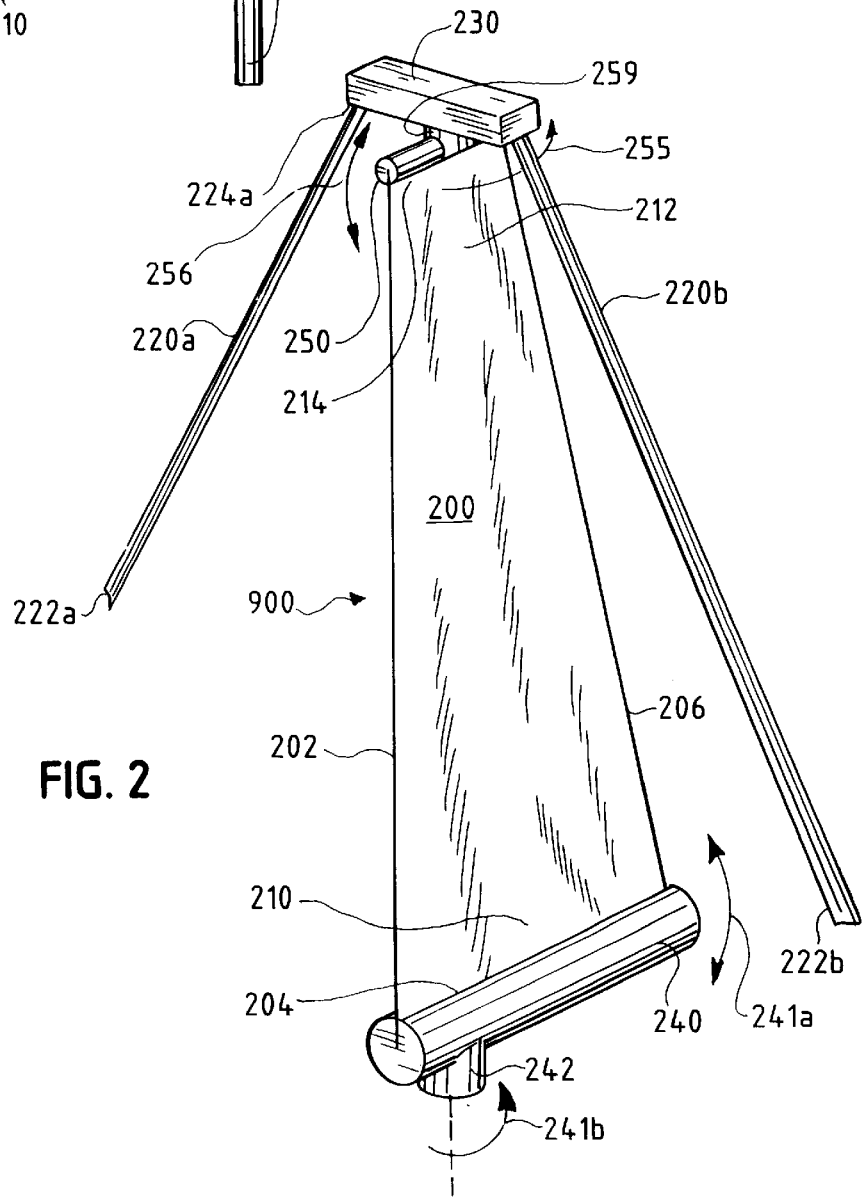
FIG. 2 is an isometric view of a preferred embodiment of the mast assembly of the present invention.

FIG. 2 is an isometric view of a preferred embodiment of the mast assembly of the present invention. The mast assembly comprises a first support member 220*a* secured at its lower end 222*a* to a sailing vessel (not shown), a second support member 220*b* secured at its lower end 222*b* to the sailing vessel, and a connecting member 230 that joins the upper ends 224*a* and 224*b* of the first and second support members 220*a* and 220*b* respectively. An "A" frame mast configuration is realized with the connection of the first supporting member 220*a*, connecting member 230 and second supporting member 220*b*. A sail 200, having a leading edge 202 exposed to the wind 900 and a following leech edge 206 is attached to a lower boom member 240 along its base or lower edge 204 and an upper boom member 250 along its upper edge 214. There are several methods available for accomplishing an assembled mast and sail arrangement. The upper edge of the sail 214 may be fastened or connected directly to the upper boom 250 first, then the upper boom along with the sail would be hoisted to the top of the mast assembly with a rigging line or the like, in which case the connection between the upper edge 214 and the upper boom 250 would be releasable. Another assembly method would be to fasten the upper edge 214 to the top boom 250 and then hoist the sail 200 and top boom 250 together using, for example, the leading edge 202 of the sail 200. Another assembly method would be to have the top boom 250 pre-positioned at the upper section of the mast assembly, i.e. connected to the connecting member 230, whereby the sail 200 would be hoisted to and connected with the upper boom 250 via clips, slotted connections, or the like. Other methods of assembly and disassembly will be recognized to those skilled in the art.

Figure 2A:
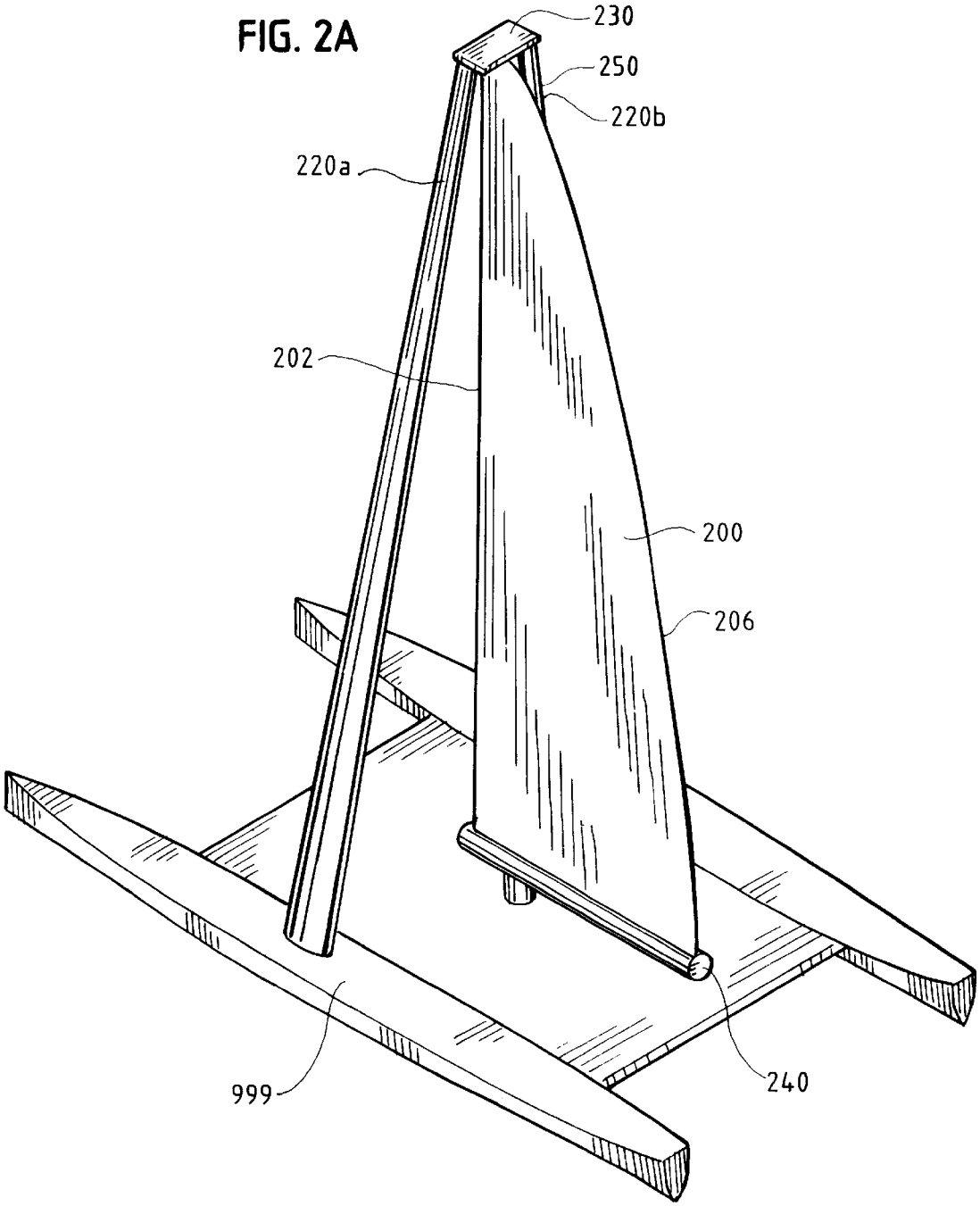
FIG. 2A is an isometric view of the preferred embodiment of the mast assembly shown, for purposes of illustration, attached to a sailing vessel of the catamaran-type.
Figure 2B:
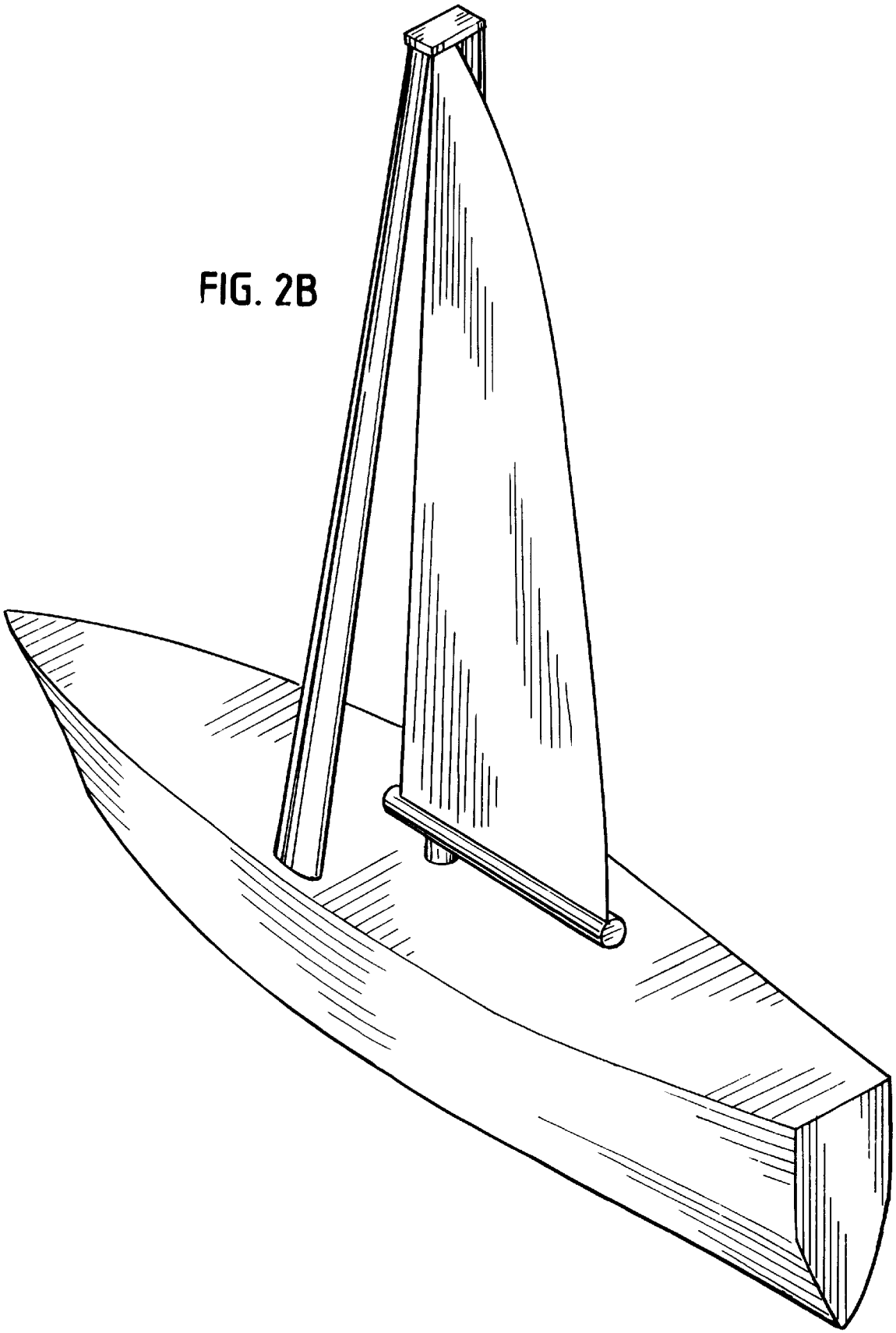
FIG. 2B is an isometric view of the preferred embodiment of the mast assembly shown, for purposes of illustration, attached to a sailing vessel of the monohull-type.

The lower section 242 of the lower boom 240 is rotatably secured to the body of the sailing vessel so that the lower boom 240 rotates in the same manner as the conventional boom 140 shown in FIG. 1 except that the boom is preferably pivoted intermediate of the two ends, preferably nearer the forward end rather than pivoted from one end, and the lower region 210 of the sail 200 attached to the boom becomes similarly controllable. The lower section 242 of the lower boom can also be pivotally attached to the sailing vessel so that the lower boom can pivot in a vertical plane, represented by movement arrow 241*a*, as well as rotate in a horizontal plane, represented by movement arrow 241*b*, resulting in omni-directional movement. The upper boom 250, which is preferably fastened along the upper edge 214 of the sail 200 is rotatably secured to the connecting member 230 via a rotational member 259 so that the upper region 212 of the sail 200 is now capable of rotation, designated for example by arrow 255, in response to the wind 900 and/or by human control. The rotational member 259 may also form a pivoting connection between the upper boom 250 and connecting member 230 so that the upper boom may also pivot in a vertical plane, represented by movement arrow 256, as well as rotate along a specific axis of rotation. In other words, the rotational member 259 does not have to be rigidly attached to the upper boom 250, but can also comprise a separate joint or the like between the rotational member 259 and the upper boom 250, or the rotational member 259 and the connecting member 230, to allow for pivoting and rotation, i.e. omni-directional movement, of the upper boom 230. See FIG. 2F, a diagrammatic side view, which more aptly illustrates the pivotability, represented by arrows 250*g*, of the upper and lower booms 250 and 240 respectively with phantom representations of a downwardly angled upper boom 250*fa* and an upwardly angled upper boom 250*fb* about the rotational member 259*f*. The pivoting of the upper boom will be usually more or less in the center of the boom, but may be closer to the forward end. The omni-directional movement of the upper and lower booms 250 and 240 respectively means that such booms do not have to remain horizontal if some other angle is desired. FIG. 2A is an isometric view of the preferred embodiment of the mast assembly shown, for purposes of illustration, attached to a sailing vessel 999. The sailing vessel 999 shown in FIG. 2A is of the catamaran type, however, one skilled in the art will undoubtedly recognize that the mast assembly of the present invention can also be used on a monohull vessel, see FIG. 2B, and the like.

Referring back to FIG. 2, the leading edge 202 of the sail 200 now becomes the leading edge of the entire sail assembly as such leading edge 202 now experiences the direct application of wind 900. This leading edge 202 is akin to a "wire"-like leading edge since the interior edge 202 of the sail is preferably constructed from or stiffened or reinforced by a wire or cord as is known in the art, with a considerably reduced diameter than that of a conventional mast which is more akin to a pole or a beam. See, for purposes of comparison, mast 120 of FIG. 1. Consequently, the turbulence experienced around and directly beyond the leading edge 202 is also considerably reduced. The upper or top boom 230 of the present invention imparts numerous significant advantages, two of which are increased wind sail surface area and increased control of the upper section 212 of the sail 200.

FIGS. 2C through 2E are diagrammatic side views of alternate sail leading edge angle positions. The opportunity to select the sail shape depending on various conditions is an opportunity that has been excluded from the sailing industry to-date. The "A"-frame mast assembly of the present invention, which opens this possibility, proposes to forever change nautical engineering in favor of more possibilities never before conceived.

The field of aerodynamics has never been homogeneous with respect to wing design and function. From the Red Baron's slow and agile biplane to the sleek sloped designs of the SR-71 Blackbird and the space shuttle, each type of airplane employs a wing design to suit the particular task at hand. The most radical example would be the revolutionary X-29 by NASA which utilizes a "forward swept wing" to allow for a higher degree of control on the inboard section of the wing, thereby allowing improved maneuverability and control and a greater angle of attack before lift loss than any conventional wing to-date. With few exceptions, the sailing community has not had the luxury to design their wing structures, i.e. sails around a desired affect, the reason being the conventional mast dictated a vertical leading edge, see leading edge 202*c* of FIG. 2C. The ability to apply various sail leading edge angles would have as drastic an effect on the sail aerodynamics as it does on airplane aerodynamics, because the sail is essentially a vertical wing. For example, replacing a conventional sail with a sleeker sloped backward sail, see leading edge 202*d* of FIG. 2D, similar to the jib and the airplane equivalent of the space shuttle, the center of effort would be lowered because of the increased sail area at the base. Consequently, the heeling force would be reduced and less sail height would be required to produce the same propulsive force. In addition, the sloped back leading edge, see FIG. 2D, would be more aerodynamic, thereby, producing less drag. Employing the forward sloped leading edge 202*e* of FIG. 2E, similar to the NASA X-29, would allow a boat to generate "lift" or drive at lower angles of attack and sail closer to the wind than conventional sail boats.

Figure 3A:
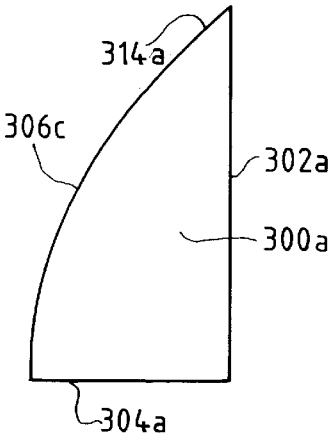
FIG. 3A PRIOR ART
FIGS. 3A and 3B are diagrammatic side views respectively of a sail shape as is traditionally known in the art and an enhanced sail shape obtained with the mast assembly of the present invention.
Figure 3B:
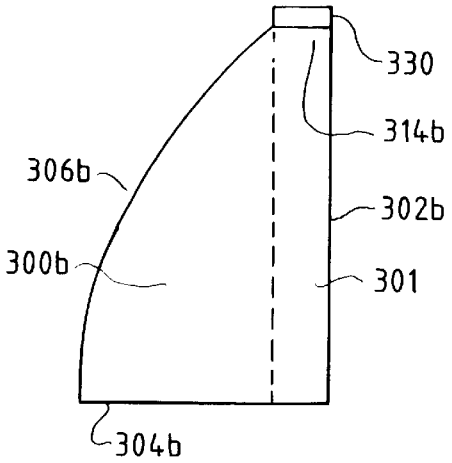

Increased surface area is demonstrated in FIGS. 3A and 3B, which show diagrammatic side views of a sail 300*a* having a pointed upper edge 314*a* as is traditionally known in the art, FIG. 3A, as compared with a sail 300*b* having an elongated upper edge 314*b* fastened within an upper or top boom member 330 as shown in FIG. 3B. The shaded portion 301 of sail 300*b* represents the additional sail surface area obtained within the sail 300*b* and shown directly beyond the leading edge 302*b* of the sail 300*b*. Since the greatest amount of propulsive or drive force is experienced in the area or region about the leading edge of a sail, the upper or top boom 330 provides an enhanced, consistent surface area profile 301 extending from the upper edge 314*b* of the sail 300*b* to the base 304*b* of the sail 300*b* along the leading edge of the sail 300*b*. This additional surface area profile 301*b* experiences the greatest amount of laminar flow along the leading edge 302*b*, which laminar flow results in the greatest pressure difference between each face of the sail, as opposed to a turbulent flow experienced toward the leech end 306*a* of the sail 300*b*. Taking advantage of laminar flow along an enhanced surface area 301, i.e. along the entire leading edge 302*b*, increases the ability to generate "lift" or propulsive force along such enhanced surface area, which effectively increase the efficiency and propulsive capacity of the entire sail 300*b*.

A further advantage of the top boom assembly of the present invention is the ability to preferably maintain the upper and lower edges of the sail at the same angle of attack (AOA) to the wind, thereby enhancing the AOA of the entire sail structure. Whereas the angle of attack with conventional sails is controlled mostly along the mid to lower section of the sail by the orientation of the bottom boom, a top boom would allow independent control of the upper section of the sail by the same means, thereby maintaining the same angle of attack along the sail top and base. Control of the sail top would be advantageous in high wind situations where the force on the sail perpendicular to the boat axis can cause the boat to tip or "heel," and if this "heeling force" becomes too great, the boat can capsize. Boaters usually compensate for sustained heeling force by reducing the exposed sail area in a difficult and time-consuming process known as "reefing." In the apparatus of the present invention, however, the need for reefing will be diminished by increasing the angle of attack with the top boom while maintaining the bottom angle of attack at the angle of maximum lift, resulting in some of the air being "spilled" off the top of the sail.

Figure 4:
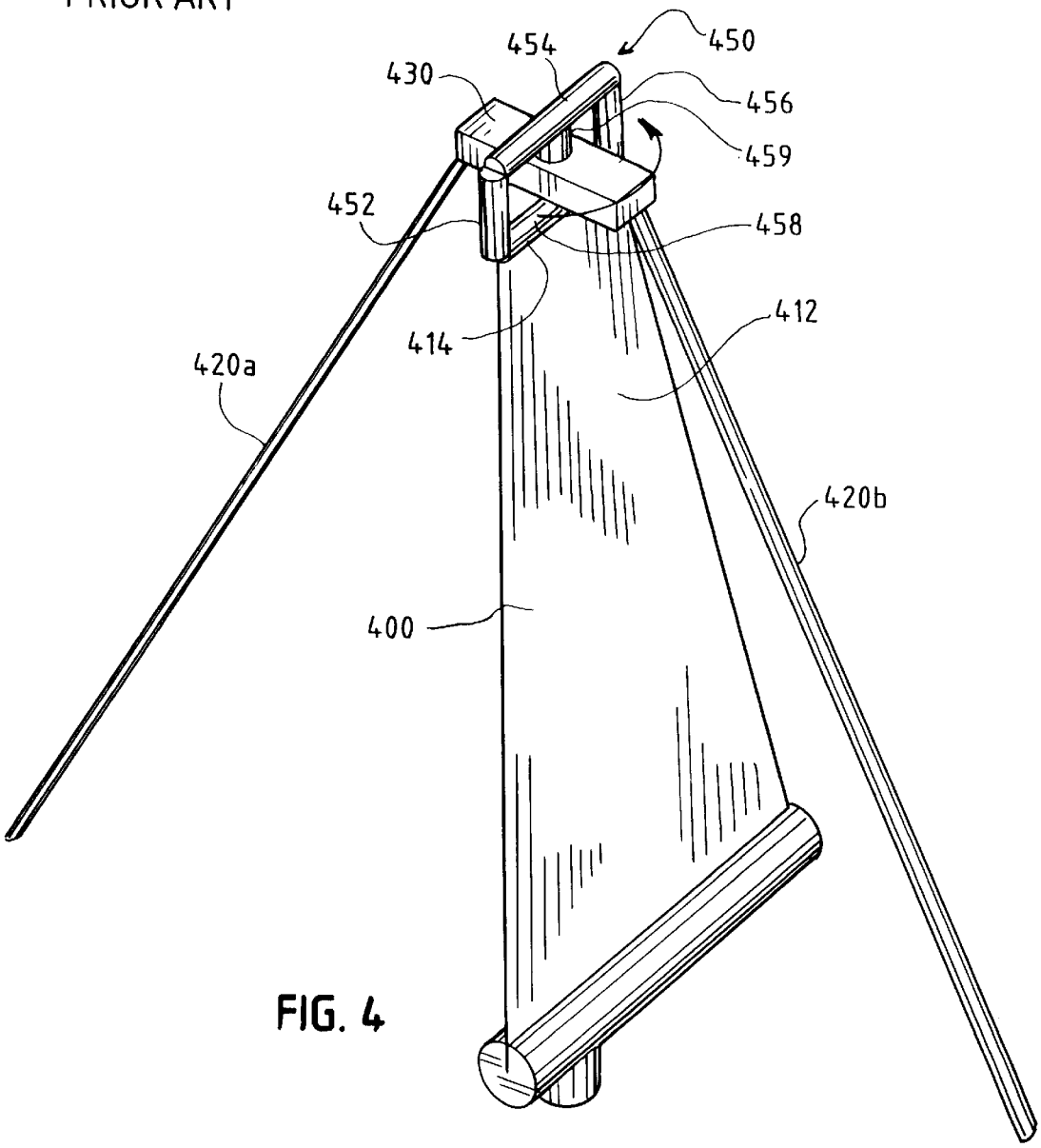
FIG. 4 is an isometric view of an alternative embodiment of the upper or top boom assembly of the present invention.

FIG. 4 illustrates an alternative embodiment of the upper or top boom assembly of the present invention wherein upper boom 450 is comprised of frame members 452, 454, 456 and 458 and rotator 459 extending between frame members 454 and 458 and through connecting member 430. Frame members 452 and 456 prevent rotation of the upper boom 450 beyond 180° in either direction due to the position of and interference with the first and second support members 420*a* and 420*b* respectively. The upper section 412 of the sail 400 is attached along its upper edge 414 to the frame member 458 of the upper boom 450. In the preferred embodiment shown in FIG. 2, the upper boom 250 is suspended from the connecting member 230.

Figure 5:
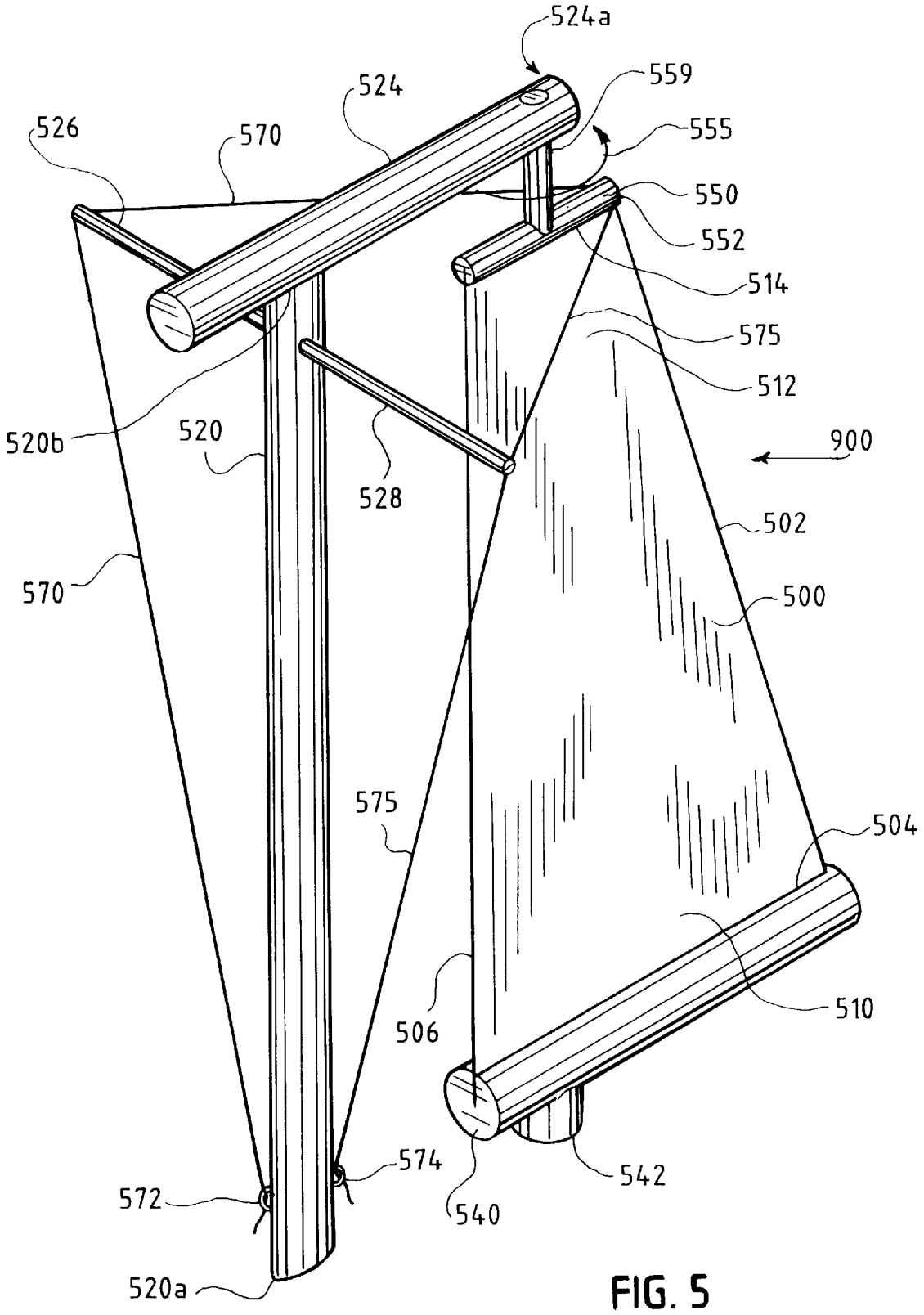
FIG. 5 is an isometric view of an alternative, non "A"-frame embodiment of the sail support assembly of the present invention.

FIG. 5 is an isometric view of an alternative embodiment of the sail support assembly of the present invention. The mast assembly comprises a first support member 520 secured at its lower end 520*a* to a sailing vessel (not shown), a second support member 524 attached to the first support member 520 at the upper end 520*b* of the first support member and extending away from the first support member 520 toward the front of the sailing vessel. A rotational member 559 is rotatably secured at one end to the outer end 524*a* of the second support member 524 and fixedly secured at its other end to an upper or top boom 550. A sail 500, having a leading edge 502 exposed to the wind 900 and a leech edge 506 is attached to a lower boom member 540 along its base or lower edge 504 and an upper boom member 550 along its upper edge 514. The lower section 542 of the lower boom 540 is rotatably secured to the body of the sailing vessel so that the lower boom 540 rotates in a more or less conventional manner and the lower region 510 of the sail 500 becomes similarly controllable. The upper boom 550, which is preferably fastened along the upper edge 514 of the sail 500 is rotatably connected via member 559 to the second support member S24 so that the upper region 512 of the sail 500 is now capable of rotation, designated for example by arrow 555, in response to the wind 900 and/or by human control. The upper boom 550 of FIG. 5 illustrates an upper boom embodiment similar in construction to the upper boom embodiment 250 of FIG. 2, i.e. sans frame members shown in the alternative upper boom 450 of FIG. 4.

Figure 6:
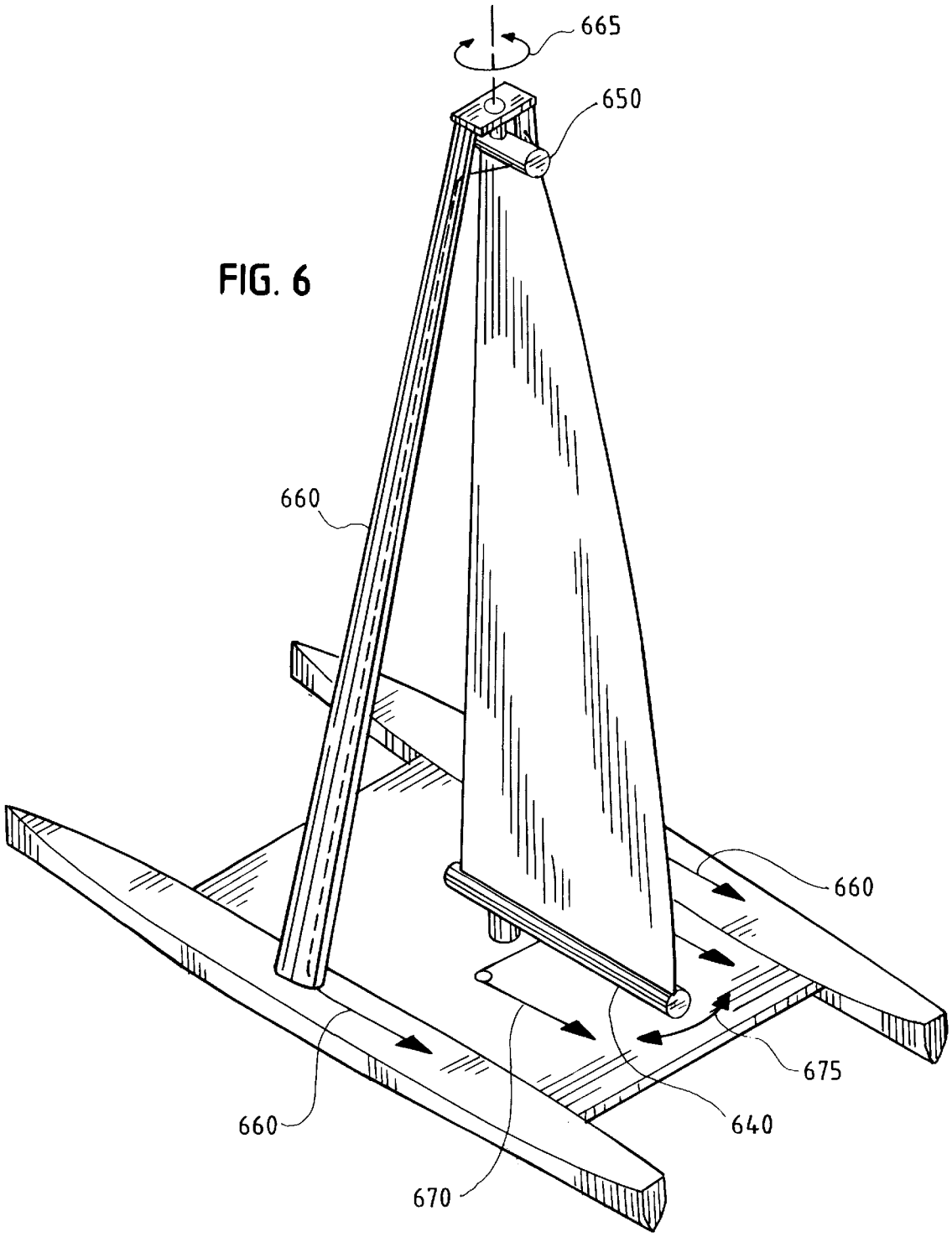
FIG. 6 is an isometric view of a preferred embodiment of the present invention for illustrating a control system that enables control over the movement of the upper boom of the invention either independently or in coordination with the lower boom of the mast assembly.

FIG. 6 illustrates one embodiment of a control system that enables control over the movement of the upper boom 650 either independently or in coordination with the lower boom 640. While FIG. 6 illustrates the upper boom embodiment 250 of FIG. 2, the upper boom embodiment 450 of FIG. 4, which is not the preferable form, could be similarly utilized, along with any other upper boom embodiment contemplated by one skilled in the art consistent with the present invention. Independent control of the upper boom 650 may be desired, for example as discussed above, to overcome an excessive "heeling force," whereby an increase in the angle of attack of the top or upper boom 650 while maintaining the angle of attack of the bottom or lower boom 640 at the angle of maximum lift or drive will result in some of the air being "spilled" off the top of the sail. Control lines 660 and 670 allow a user to manipulate the rotation or orientation of the upper boom 650 and lower boom 640 and their respective angles of attack, with axis of rotation arrows 665 and 675 illustrating the same.

Figure 7:
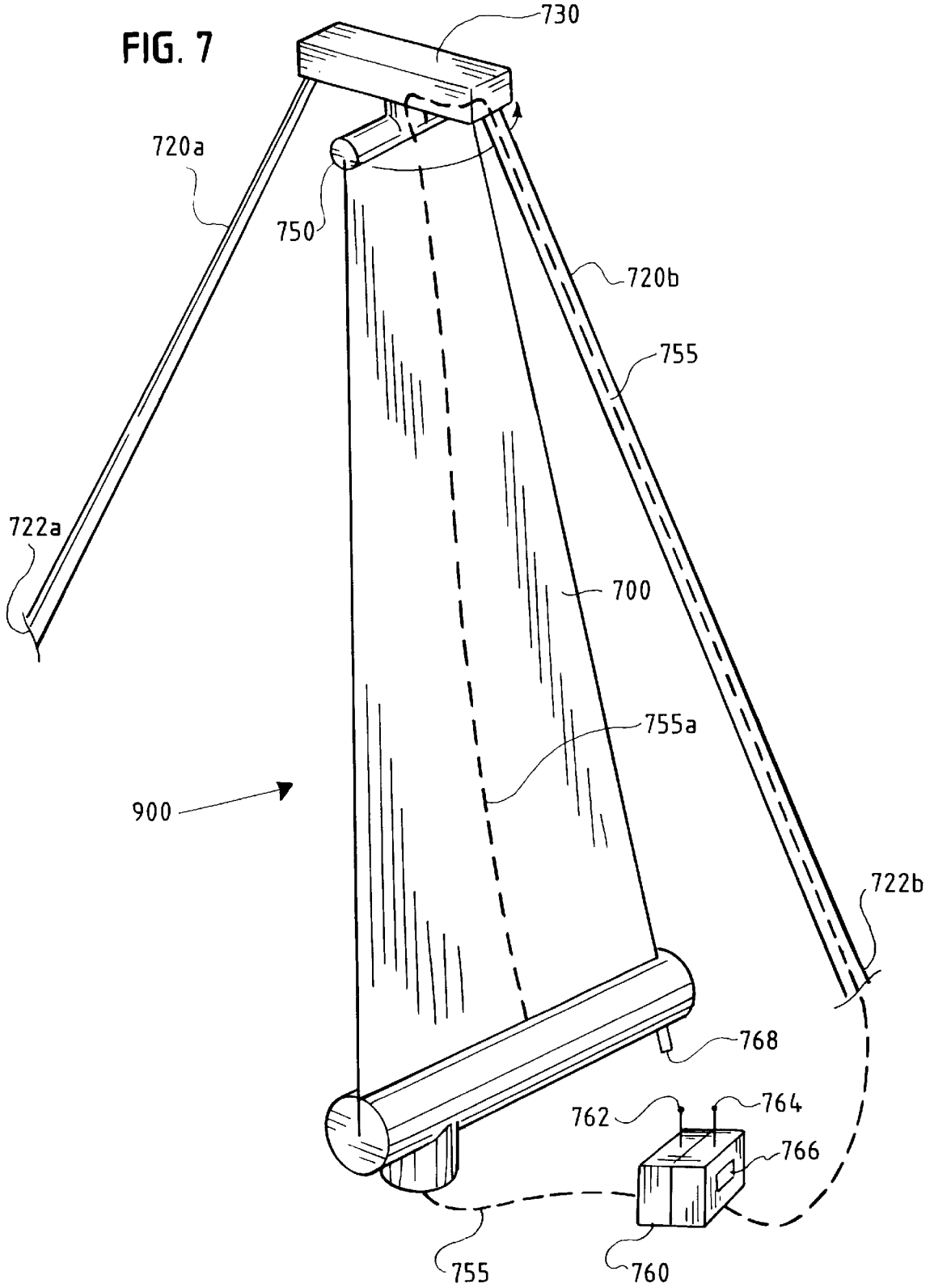
FIG. 7 is a diagrammatic view of an alternative embodiment of a control system.

FIG. 7 illustrates an alternative embodiment of a control system that enables control over the movement of the upper boom 750 either independently or in coordination with the lower boom 740. A control connection 755 of any desired type, i.e. electrical, hydraulic or the like, shown with dashed lines is established between the upper boom 750 and lower boom 740 by way of the connecting member 730 and one of the support members 720*a* or 720*b*, which support members are mounted to the sailing vessel at their lower portions 722*a* and 720*b* respectively. Reference numeral 760 represents a control device that coordinates the movement of the upper boom 750 with respect to the lower boom 740. This coordination can either be activated automatically, i.e. movement of the lower boom 740 results in an identical movement of the upper boom 750, in which case the control device may be hidden from view, or it may be activated manually by a sailor. A switch 766 might be placed on the control station 760 to switch between manual and automatic control, or such switch might be placed directly on the lower boom 768 or some other accessible location on the sailing vessel. If manual control is desired, the control station 760 would have a separate control means 762 to control the movement of the upper boom 750 and separate control means 764 to control the movement of the lower boom 740. Of course, the upper boom 750 may merely move in response to the wind 900 in which case the only boom that would be manually controlled would be the lower boom 740. The control system may be formed using different paths such as, for example, establishing the connection 755*a* directly from the upper boom 750 to the lower boom 740 through the sail 700. The control system may also be purely mechanical as shown previously in FIG. 6. Other control schemes and variations may be implemented as known in the art.

Referring back to FIG. 5, a control system may be employed similar to that previously described in FIG. 6 that enables control of the movement of the upper boom 550 either independently or in coordination with the lower boom 540. Rigging lines 570 and 575 would extend from retention members 572 and 574 to the leading edge 552 of the upper boom 550 by way of side extension members 526 and 528. Lines 570 and 575 may be manually manipulated to control the rotation direction of the upper boom 550. The lower boom 540 may also be manually manipulated thrqugh a conventional crank and gear system, motor means and in other ways known or adapted from the art.

Figure 8:
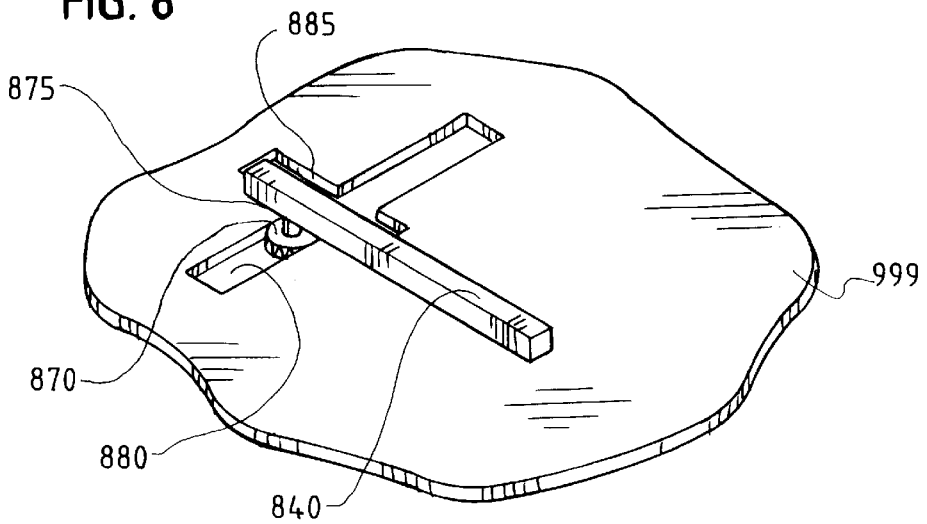
FIGS. 8 and 8A are isometric views of movable, alternative, lower boom arrangements or embodiments of the present invention.
Figure 8A:
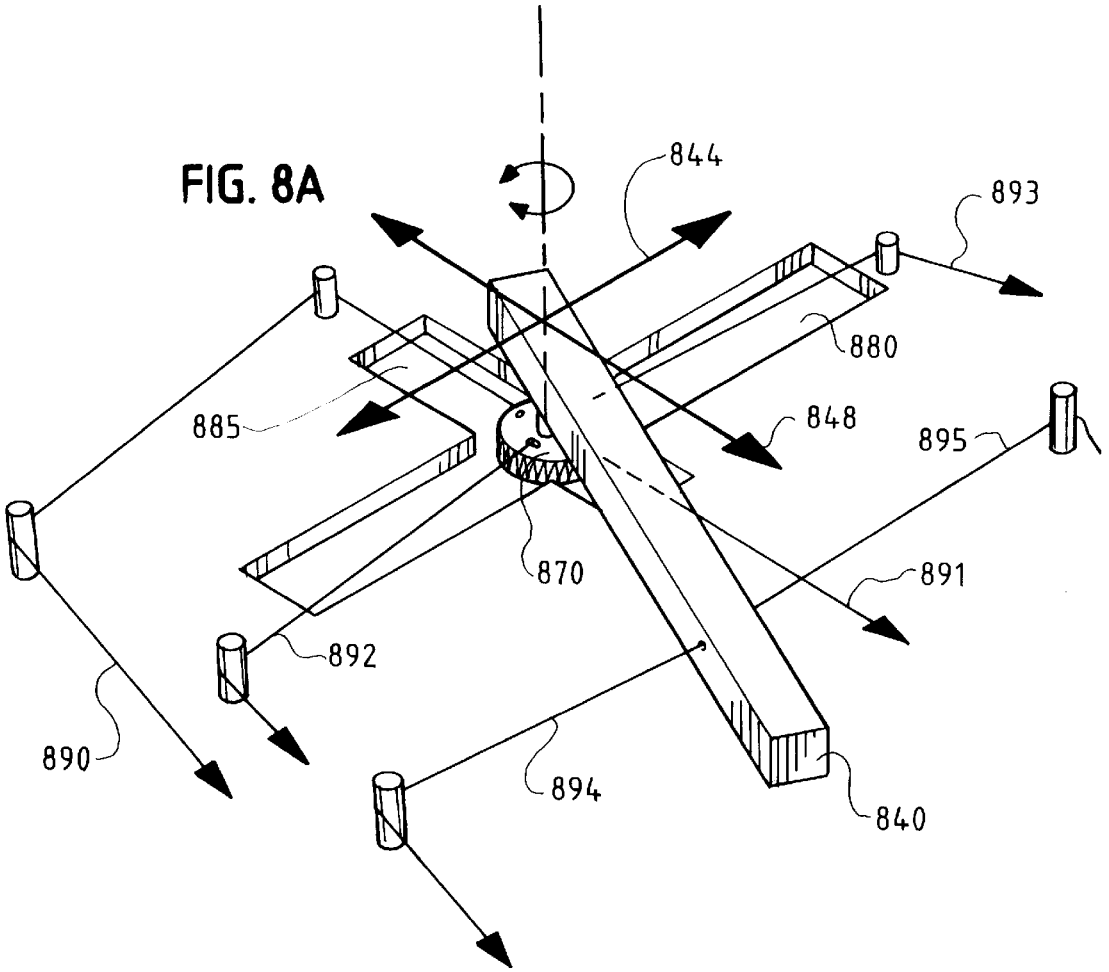

FIGS. 8 and 8A are isometric views of an alternative lower boom embodiment 840 of the present invention that is laterally or omni-directionally movable within the hull of a sailing vessel 999. A movable lower boom would be desirable if the axes of rotation of the upper (not shown) and lower boom were desired to be askew or along different planes. While FIGS. 8 and 8A show two intersecting channels 880 and 885, it will be understood that a variety of channel configurations could be implemented to accomplish a particular lower boom placement along the hull of the sailing vessel 999. The lower boom 840 is moveable within the channels by way of a movable mounting member 870 connected to the lower boom 840 with a rotational shaft 875. The shaft 875 may either be fixedly connected to the boom 840 and then rotatably connected to the mounting member 870, or fixedly connected to the mounting member 870 and rotatably connected to the boom 840. The mounting member 870 moves within the channels 880 and 885, where such movement can be slidable movement, gear driven movement, or any other type of mechanical or electrical movement known to one skilled in the art. FIG. 8A illustrates one embodiment of a control scheme with control lines 890–893 attached to the moveable mounting member 870 and control lines 894 and 895 attached to the boom 840 with movement illustrated by arrows 844 and 848 as shown. Of course, as previously described in connection with FIGS. 6 and 7, the control lines 890–895 may either be manual, i.e. rigging lines, or automatic with electrical, hydraulic or other assisted controls.

Figure 9:
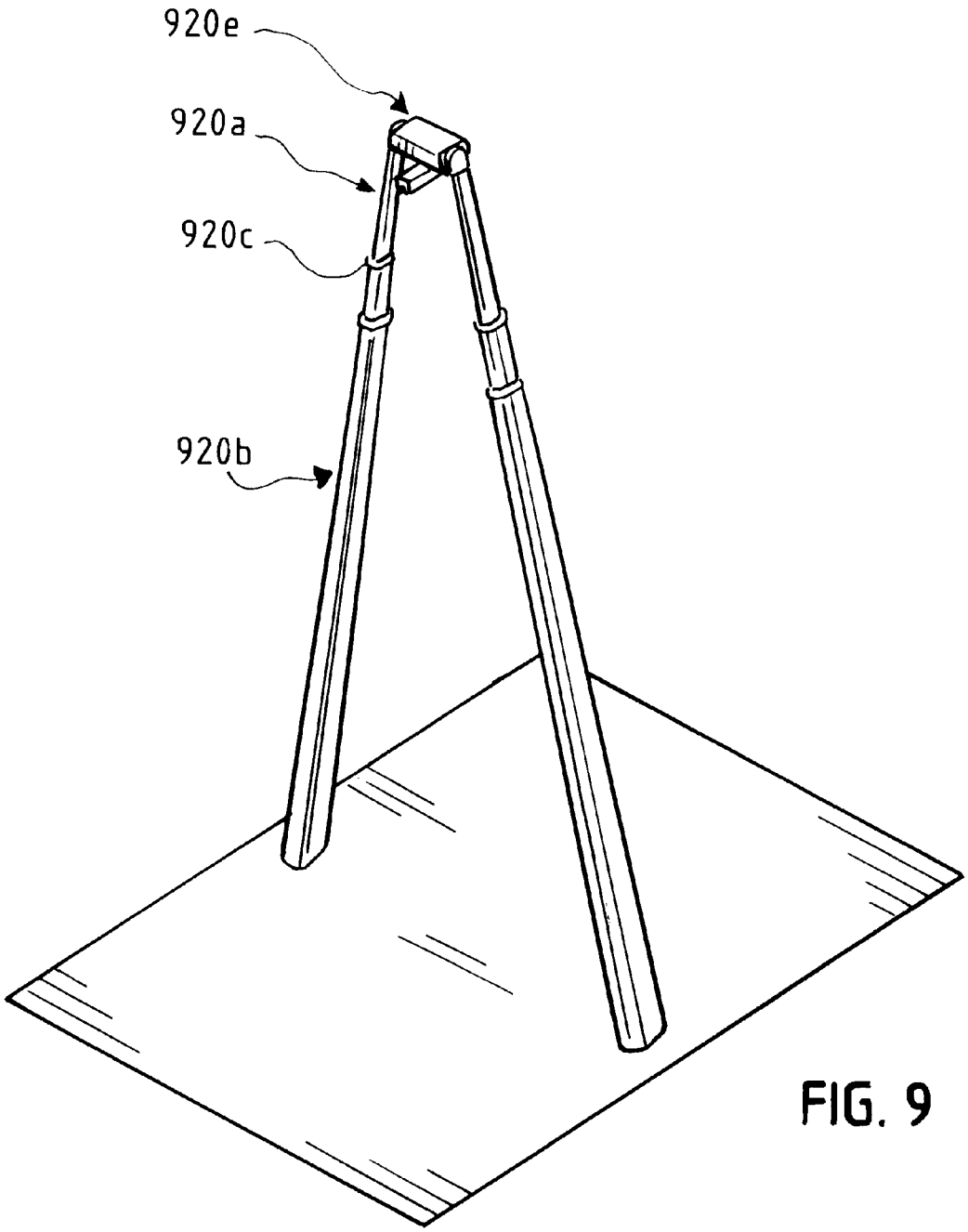
FIGS. 9 and 9A through 9D are isometric views of an alternative embodiment of the mast assembly of the present invention showing a collapsible mast.
Figure 9A:
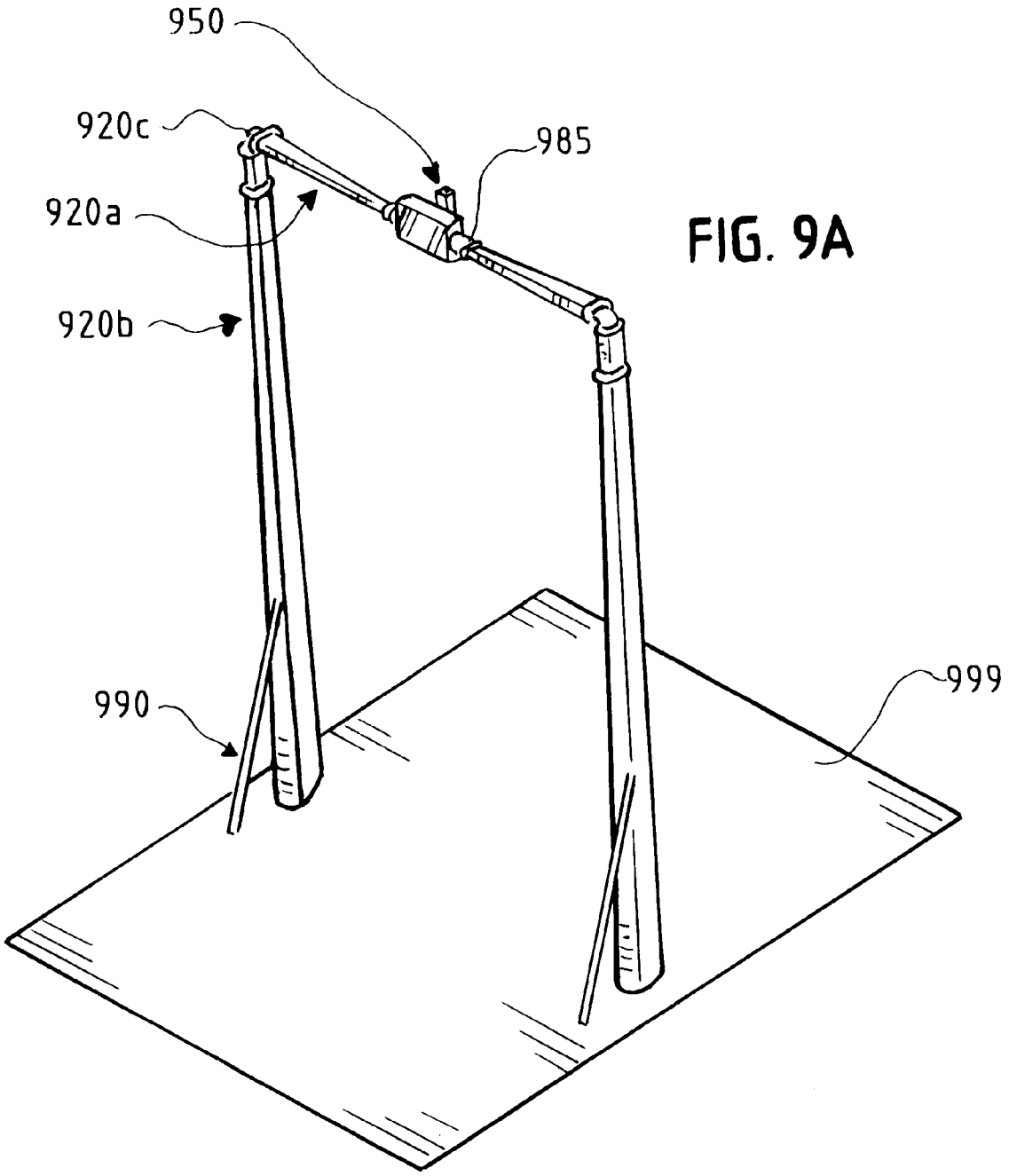
Figure 9B:
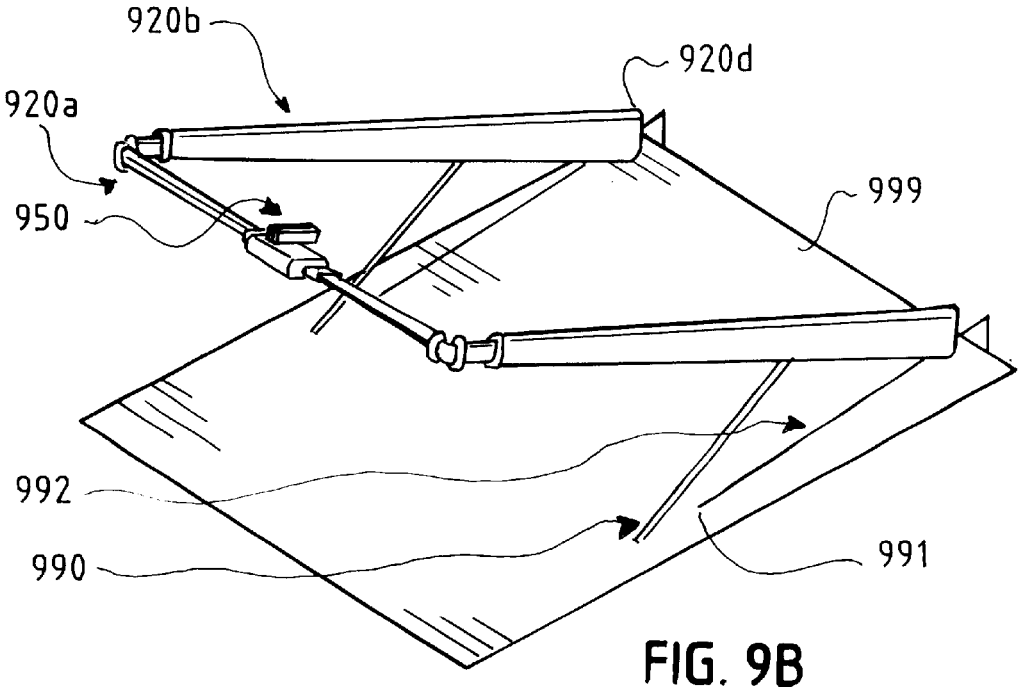
Figure 9C:
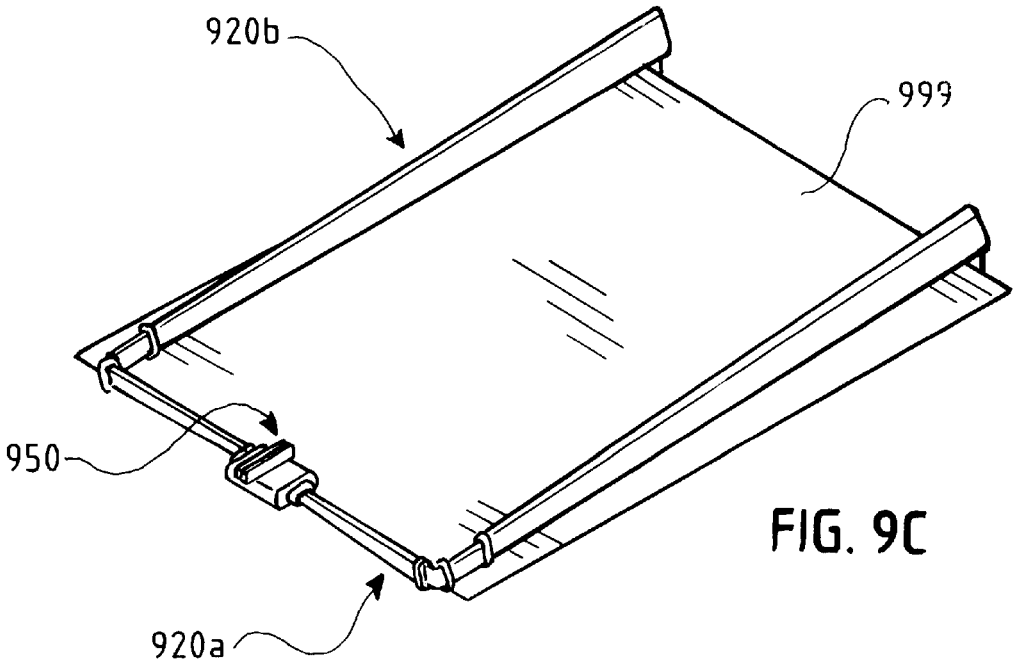
Figure 9D:
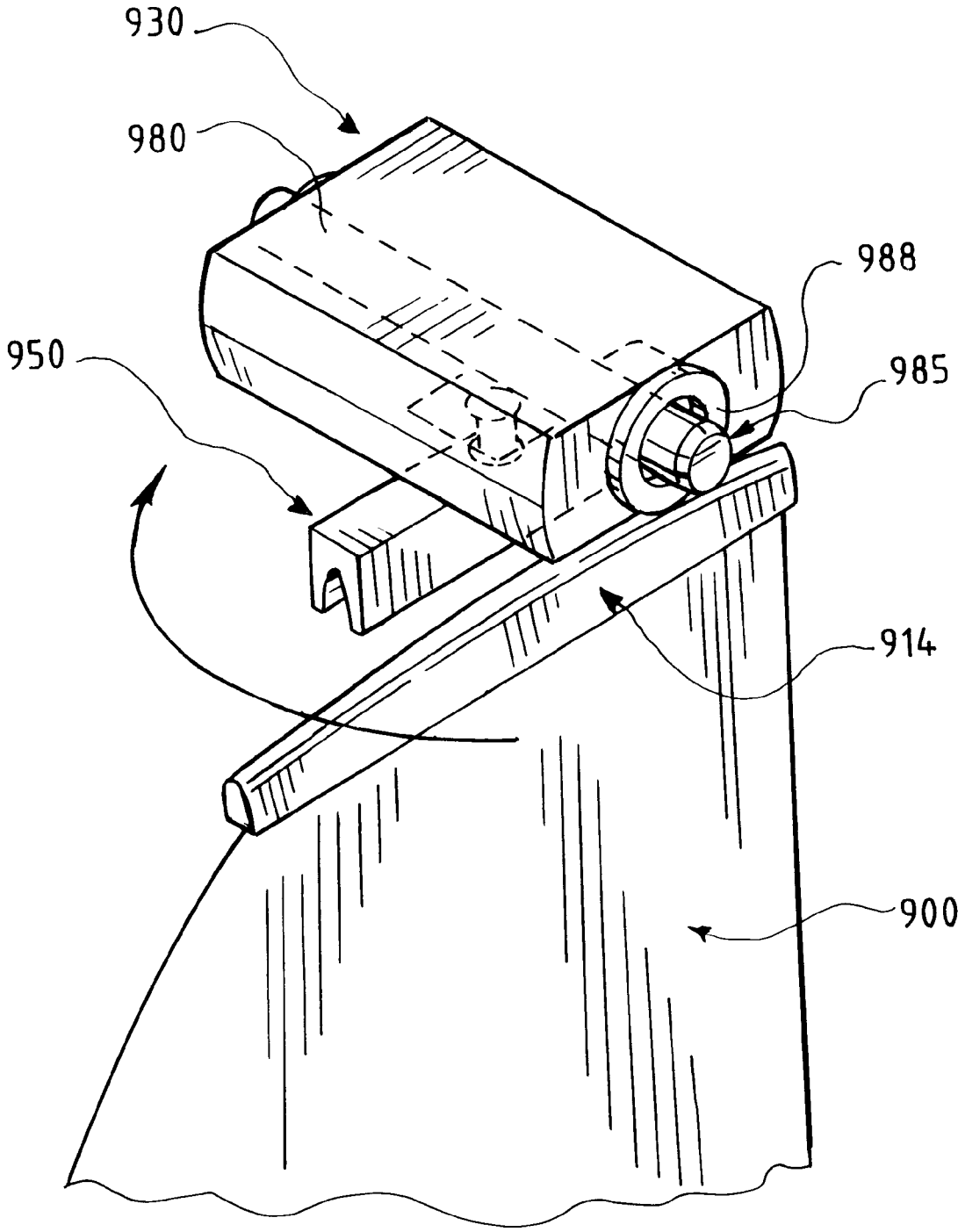

FIGS. 9 and 9A through 9D are isometric views of an alternative embodiment of the mast assembly of the present invention. Each side of the "A"-frame collapsible mast of FIGS. 9 and 9A through 9D comprises an upper mast section 920*a*, a lower mast section 920*b* and a joint or hinge section 920*c*. FIG. 9D is a close-up view of region 920*e*, which illustrates sail 900 with an upper edge or sail top 914, upper or top boom 950 rotatably connected to a connecting member 930, such connecting member 930 having an axle member 980 with joints 985 on either end for connection to each upper mast section 920. FIG. 9 illustrates the collapsible mast assembly in a fully erect, sailing position.

FIG. 9A illustrates the collapsible mast assembly of the present invention in a partially collapsed position. The upper mast sections collapse toward each other at the joints 985 and 920*c* thereby assuming a substantially perpendicular relationship with respect to the lower mast sections 920 that have now pivoted away from each other. Support arms extend from the sailing vessel 999 to the lower mast section 920*b*. Prior to the partial collapse of the mast assembly, the sail 900 is removed from the upper boom assembly by separating the sail edge 914 from the upper or top boom 950, see FIG. 9D. As the mast assembly partially collapses, the upper or top boom rotates 90° by way of gear means, see reference numeral 988 of FIG. 9D, such that the upper or top boom 950 will be positioned away from the deck of the sailing vessel 999 when fully collapsed, see FIGS. 9A through 9C.

FIG. 9B illustrates the lowering of the collapsible mast assembly of the present invention. The base of the lower mast 920*d* slides rearward along a track 992 while the support arm rotates about position 991. FIG. 9C illustrates the mast assembly in a fully collapsed position with the upper mast sections 920 resting on the deck of the sailing vessel 999.

The collapsible mast assembly embodiment of the present invention is preferably collapsible in two stages. First, the mast bends at the joint between the upper and lower mast sections, see FIG. 9A. As the mast bends, the upper boom assembly preferably rotates 90°, preferably actuated by a gear train between the top mast and the upper boom assembly, see FIG. 9D. Of course, the upper boom assembly does not have to rotate as the mast assembly is collapsed, or it can rotate at angles other than 90°, with these decisions dependent on the user's final mast assembly configuration. The second stage of the collapse lowers the mast to the deck of the sailing vessel. The base of the lower mast sections slide along a "track" while the lower mast sections are supported by stationary support arms. The movement of the lower mast sections along the sailing vessel during the collapse can be accomplished in a variety of ways such as, for example, with a gear system, hydraulically, chain-driven or the like. The purpose of the track is to prevent the collapsing mast from reaching a toggle point between the lower mast sections and the support arm, thereby reducing the force needed to lower the mast assembly the last several degrees.

The "A"-frame mast was never truly adopted by the sailing community as a viable alternative to the conventional vertical mast system. Consequently, there is little experimental data on the aerodynamics of such a frame system. However, a conventional "A"-frame mast exhibits the same loss of lift due to sail top deflection, similar to a conventional vertical mast sail system. It is assumed that it was for this reason that the increased efficiency gained from a wire leading edge did not warrant the adoption of an "A"-frame mast design over the large jib design. The mast assemblies of the present invention each benefit from a "wire" leading edge, and the top or upper boom member enabled the present inventor to more realistically operate with an "A"-frame by effectively removing the problem of sail top deflection.

The top boom solves the single greatest obstacle in "A"-frame aerodynamics, namely the sail top deflection. By replacing the point connection for the sail top of a conventional "A"-frame mast with a linear connection similar to the conventional bottom boom, the sail top deflection was eliminated. In addition, the advantage of a wire leading edge was proven conclusively by the present inventor with qualitative flow visualization studies. The presence of laminar flow at low angles of attack allows the ability to generate greater lift or drive than a similar sail with a vertical mast under identical conditions.

In addition to the increased sail area from the top boom, the ability to independently control the sail top and bottom adds a freedom to sailing not previously experienced. As experimentally observed, the sail top can be opened or closed to either spill air out of or collect air into the sail. However, the present inventor has discovered that regulating the top boom angle of attack to reduce the heeling force has little to no affect at large bottom boom angles of attack, as observed by experimental force measurements. Consequently, the present inventor has concluded that the "A"-frame with top boom system would not entirely alleviate the need for a reefing system as previously discussed.

One of the single greatest advantages of the "A"-frame with top boom over existing sail systems is the ability to generate lift or drive at all angles of attack. Therefore, a sailor would have a greater range of possible sailing directions for any given wind direction. As stated earlier, the closest a modern sailboat with vertical mast can sail to the wind is approximately 35° under average conditions. The exact reduction due to the "A"-frame and top boom is difficult to predict, however, a safe assumption would be about 10°. A 10° reduction would result in 20° increase in possible sailing directions.

It is easiest to see the advantage of a 10° increase in possible sailing direction when demonstrated using the following sailing examples:

Point to Point Sailing

One of the greatest difficulties in sailing is getting back to the beach or dock when the wind is coming from the shore. To overcome the headwind, the captain must steer the boat in a zigzag pattern, a process generally known as "tacking." A boat outfitted with an "A"-frame and top boom system of the present invention would drastically reduce the number or distance of tacks needed to reach the same destination.

Channel Sailing

Channel sailing is seen in areas such as the Florida Keys where a long narrow water channel exists between the keys and the mainland. Unlike, point-to-point sailing, which can be accomplished by tacking, channel sailing cannot because there is not enough room. A tacking boat would be a hazard to all other boats in the channel. Therefore, if wind conditions are not right, the only option would be propulsion from an external source such as a gas or electric motor. A decrease in 10° minimum angle of attack to the wind would drastically increase the sailing conditions in which a sailor would not have to rely on a motor.

Racing

The most advantageous benefit from a closer possible angle of attack lies in racing. For example, two boats both heading for a marker would have to take drastically different routes depending on the sail configurations. Under a 15-degree headwind to the buoy, the boat with the "A"-frame would have a significantly shorter distance to travel. Using an example distance of 15 miles, the conventional boat would have to travel 2 miles further and 10% faster to reach the same point at the same time. In a sport such as sailing, where races are won by meters, this would constitute a significant advantage.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A sail support assembly for use on a sailing vessel comprising:

a. a first support member secured at its lower portion to the sailing vessel, b. a second support member secured at its lower portion to the sailing vessel, c. a connecting member positioned between the upper portions of the first and second support members, d. a first boom member longitudinally rotatably secured to the connecting member and adapted for support of the upper edge of a sail, e. a second boom member longitudinally rotatably secured to the sailing vessel and adapted for attachment to the lower edge of the sail, and f. means for controlling movement of the first boom member during sailing independently of movement of the second boom member.

2. A sail support assembly in accordance with claim 1 wherein the controlling means comprises means for selectively rotating the first boom member independently of rotation of the second boom member.

3. A sail support assembly in accordance with claim 2 wherein the means for selectively rotating comprises a control line having one end operatively connected to the first boom member and another end operable by a user of the sailing vessel.

4. A sail support assembly in accordance with claim 2 wherein an "A" frame configuration is formed by the connection between the first support member, the connecting member and the second support member.

5. A sail support assembly in accordance with claim 4 wherein the mast assembly is collapsible onto the sailing vessel deck.

6. A sail support assembly in accordance with claim 1 wherein the axis of rotation of the first boom member and second boom member are coincident.

7. A sail support assembly in accordance with claim 1 wherein the axis of rotation of the first boom member and second boom member are not coincident.

8. A sail support assembly in accordance with claim 1 wherein the controlling means comprises a control connection selected from the group consisting of an electrical connection, a hydraulic connection, and a mechanical connection.

9. A sail support assembly in accordance with claim 8 wherein the control connection extends along one of the first and second support members.

10. A sail support assembly in accordance with claim 8 further comprising means for a sailing vessel operator to control the position of the second boom member with respect to the hull of the sailing vessel.

11. A sail support assembly in accordance with claim 10 wherein the rotation of the second boom member with respect to the hull of the sailing vessel is controllable.

12. A sail support assembly in accordance with claim 11 wherein the lateral placement or position of the second boom member with respect to the hull of the sailing vessel is further controllable.

13. A sail support assembly in accordance with claim 1 wherein the leading edge of a sail mounted between the upper and lower boom members is substantially vertical.

14. A sail support assembly in accordance with claim 1 wherein the leading edge of the sail is not substantially vertical.

15. A sail support assembly in accordance with claim 14 wherein the leading edge of the sail is forwardly sloped.

16. A sail support assembly in accordance with claim 14 wherein the leading edge of the sail is sloped back.

17. A sail support assembly for use on a sailing vessel comprising:

a. a first support member secured at its lower portion to the sailing vessel, b. a second support member secured at its lower portion to the sailing vessel, c. a connecting member positioned between the upper portions of the first and second support members, d. a first boom member longitudinally rotatably secured to the connecting member and adapted for support of the upper edge of a sail, e. a second boom member longitudinally rotatable secured to the sailing vessel and adapted for attachment to the lower edge of the sail, f. wherein a sail may be positioned in sailing alignment spaced from the first and second support members sufficiently to effectively reduce any turbulent wind shadow along the leading edge of the sail when exposed to air movement, g. wherein the first and second boom members rotate independently of each other, h. wherein an "A" frame configuration is formed by the connection between the first support member, the connecting member and the second support member, i. wherein the mast assembly is collapsible onto the sailing vessel deck, and j. wherein the first and second support members are hinged along their midsections to facilitate their collapsibility.

18. An assembly for controlling and positioning the sail on a sailing vessel comprising:

a. a mast member not directly attached to a sail and mounted upon a sailing vessel at its lower end, b. a first laterally extending support member attached to the upper edge of the sail and rotatably suspended from an upper portion of the mast member, c. a second laterally extending support member attached to the lower edge of the sail and rotatably secured to the sailing vessel, and d. means for selectively rotating the first laterally extending support member during sailing independently of rotation of the second laterally extending support member.

19. An assembly in accordance with claim 18 wherein the first laterally extending support member is attached to an extension from the mast.

20. An assembly in accordance with claim 18 wherein a portion of the leading edge of the sail is positioned closer to the bow of the sailing vessel than at least one of the laterally extending support members.

21. An assembly in accordance with claim 18 wherein the mast member is in the form of an "A" frame and further comprises a pair of upwardly extending frame support members each anchored to the sailing vessel adjacent their lower ends and joined at their upper ends by a connecting member.

22. An assembly in accordance with claim 21 wherein the first laterally extending support member is suspended from the connecting member.

23. An assembly in accordance with claim 22 wherein the sail rotates below the connecting member and such rotation is limited by the pair of frame support members.

24. An assembly in accordance with claim 18 wherein the sail is capable of rotating 360° on the mast member.

25. An assembly in accordance with claim 18 wherein the sail can rotate no more than 180° in either direction.

26. An assembly in accordance with claim 18 wherein at least one of the laterally extending support members is substantially horizontally disposed.

27. An assembly in accordance with claim 18 wherein at least one of the laterally extending support members is disposed at a substantial angle with respect to the horizontal.

28. A mast assembly for a sailing vessel comprising:

a. a pair of principal mast members adapted for erection upon the deck of a sailing vessel in side by side relationship, b. said pair of principal mast members being hingedly secured to the deck to allow the pair of masts to be rotated through a substantially 90° arc from a completely erected position to a position parallel to the deck longitudinally of the deck, c. each pair of principal mast members also being inclinable from a substantially vertical position to an inclination toward each other, d. the upper portions of the mast members being connected together by an intermediate connecting support provided in a central position with means to support a sail, e. the mast members being each comprised of an upper section and a lower section hingedly connected together for folding toward each other, f. the upper sections of the mast members having a length dimension such that when folded toward each other the upper sections are disposed substantially parallel to the deck of the vessel and when fully erected are inclined toward each other.

29. A mast assembly in accordance with claim 28 wherein the lower portions of the mast members are mounted on tracks on the deck such that the lower portions when rotated at least partially to a substantially horizontal position may be moved on the track toward an end of the sailing vessel.

30. A mast assembly in accordance with claim 28 wherein the intermediate connecting support is transversely rotatable such that the sail support is rotatable from between the mast members upon folding of the mast members.

31. A mast assembly for positioning the sail on a sailing vessel comprising:

a. an "A" frame mast mounted upon the sailing vessel, b. a sail connected to the mast comprising a leading or forward edge, a leech or rearward edge, an upper section bounded by an upper edge and a lower section bounded by a lower edge, c. a first means to rotate the upper edge of the sail, d. a second means to rotate the lower edge of the sail, e. said first means capable of producing a rotation of the upper section of the sail independently of rotation of the lower section of the sail and said first means further comprising means for selective operation by a user during sailing.

32. A mast assembly in accordance with claim 31 wherein said first means further comprises an upper boom member rotatably positioned between the upper section of the sail and the mast.

33. A mast assembly in accordance with claim 32 wherein said second means further comprises a lower boom member connecting the lower section of the sail with the sailing vessel, such lower boom member further being rotatably and laterally positionable about the deck of the sailing vessel.

34. A mast assembly in accordance with claim 33 wherein the sail leading edge is sloped forward.

35. A mast assembly in accordance with claim 33 wherein the sail leading edge is sloped backward.

36. A mast assembly in accordance with claim 33 wherein at least one of the upper and lower boom means are disposed substantially horizontally.

37. A mast assembly in accordance with claim 33 wherein at least one of the upper and lower boom means are disposed at a substantial angle with respect to the horizontal.

38. A mast assembly comprising an upper pivoted boom rotatably supported from the upper portions of the said mast assembly and a lower boom assembly rotatable with respect to the hull of a vessel upon which the mast assembly is mounted, with the lower boom assembly being further adjustable in position with respect to the deck of the vessel laterally or longitudinally, the mast assembly further comprising means for controlling movement of the upper pivoted boom during sailing independently of movement of the lower boom assembly.

39. A mast assembly in accordance with claim 38 wherein a mounting connected to the rotatable boom assembly is moveable both laterally and longitudinally within the deck of the hull of the vessel in groove-type openings in the deck of the hull of the vessel.

40. A mast assembly in accordance with claim 39 wherein the rotatable lower boom assembly is movable during actual sailing by a rigging control arrangement.

* * * * *